United States Patent [19]

Richards

[11] 4,403,409

[45] Sep. 13, 1983

[54] FASTENING APPARATUS AND CONTROL SYSTEMS THEREFOR

[75] Inventor: Edwin H. Richards, Ripple, England

[73] Assignee: L & H Designs Limited, Gloucestershire, England

[21] Appl. No.: 235,260

[22] Filed: Feb. 17, 1981

[30] Foreign Application Priority Data

May 6, 1980 [GB] United Kingdom ..... 8015047

[51] Int. Cl.[3] ..... B23P 19/00; B23P 11/00

[52] U.S. Cl. ..... 29/798; 29/521; 29/432.1

[58] Field of Search ..... 29/798, 437, 438, 432.1, 29/521, 522, 509, 21.1; 72/453.03, 325, 338

[56] References Cited

U.S. PATENT DOCUMENTS

| | | | |
|---|---|---|---|
| 2,671,361 | 3/1954 | Sandberg | 29/432 |
| 3,599,318 | 8/1971 | Behlen | 29/509 |
| 3,726,000 | 4/1973 | Hafner | 29/521 |
| 3,862,485 | 1/1975 | Hafner | 29/521 |
| 3,900,937 | 8/1975 | Schleicher | 29/522 |
| 3,934,327 | 1/1976 | Hafner | 29/509 |
| 3,981,064 | 9/1976 | Hafner | 29/521 |
| 4,041,598 | 8/1977 | D'Angelo | 29/432 |
| 4,176,441 | 12/1979 | Hafner | 29/432.1 |

*Primary Examiner*—Ervin M. Combs
*Assistant Examiner*—Steven E. Nichols
*Attorney, Agent, or Firm*—Allison C. Collard; Thomas M. Galgano

[57] ABSTRACT

Apparatus operable to fasten together overlying metal sheets has a cooperating piercing-and-forming punch and die set, which partially sever and displace a localized region of the sheets out of the planes thereof, and a flattening punch which then operates to spread the displaced region sideways and fasten the sheets together with a clenching action. A die mounting for said piercing-and-forming die and a punch mounting for said flattening punch are sequentially and separately operable, respectively, by two hydraulical piston and cylinder arrangements which effect movement thereof relatively to said piercing-and-forming punch. An associated control system comprises pressure sensing devices which sense the operating pressures in hydraulic feeds respectively supplying the piston hydraulic cylinders. These devices are connected to respective level comparators which, when the connected devices sense predetermined feed pressures, provide input signals to a control circuit to initiate sequencing control steps thereof. The control circuit controls solenoid feed valves for the hydraulic cylinders.

11 Claims, 11 Drawing Figures

FASTENING APPARATUS AND CONTROL SYSTEMS THEREFOR

BACKGROUND OF THE INVENTION

1. Field of the Invention

This invention relates to apparatus operable to fasten together overlying metal sheets or webs. It is particularly concerned with the type of apparatus which for this purpose employs a co-operating piercing-and-forming punch and die set, to partially sever and displace a localised region of the sheets out of the planes thereof, and a flattening punch which then operates to spread the displaced region and thus fastens the sheets together with a clenching action. The invention also relates to control systems for such apparatus.

2. Description of the Prior Art

Apparatus of the foregoing type is disclosed in U.S. Pat. Nos. 1,343,003 and 1,394,915, and such apparatus at present in use normally has separate reciprocable rams, respectively associated with the piercing-and-forming die and the flattening punch, operated by a direct mechanical drive from a rotating crankshaft/eccentric arrangement. As a result the apparatus is of heavy fixed construction, with the obvious disadvantages that this entails—particularly that the work has to be brought to the apparatus for fastening, which may be inconvenient or even impossible—and adjustment of the clenching action to suit different types and thicknesses of work presents problems.

SUMMARY OF THE INVENTION

The main object of the invention is to provide apparatus of the type concerned which is of relatively light weight, and in particular can be designed in portable hand-held form, and with which the adjustment problems of prior forms of apparatus are readily solved. A further object is to provide a control system which is particularly suitable for use with such apparatus.

Apparatus of the type concerned, according to one aspect of the invention, has die and punch mounting sections which are movable in sequence relatively to a piercing-and-forming punch and respectively mount a corresponding piercing-and-forming die and a flattening punch, the movable die and punch mounting sections being respectively and separately operable hydraulically by two piston and cylinder arrangements.

The operation of the movable die and punch mounting sections of the apparatus by the hydraulic piston and cylinder arrangements may employ intermediate levers. Thus the apparatus may operate with a scissor action, the piercing-and-forming die and the flattening punch being mounted at adjacent ends of two arms sharing a common pivot axis and at the other ends of which the hydraulic pistons act, each such arm having a scissor relationship with a third arm fixed with respect to the hydraulic cylinders and mounting the piercing-and-forming punch.

As an alternative to operation of the piercing-and-forming die and flattening punch through the intermediary of levers, direct actuation thereof may be achieved with a coaxial disposition of the piston/cylinder arrangements aligned with linear movement of the piercing-and-forming die and flattening punch. In this case the piston rod of the pierce-and-form piston may project towards the piercing-and-forming punch to provide the mounting for the die, and be hollow for passage of the flattening punch which is connected to the other piston. The rod of this other piston may also be hollow and project in the opposite direction, i.e. away from the piercing-and-forming punch, to provide the mounting for the flattening punch which thus passes coaxially through both pistons.

In the control of apparatus embodying a plurality of actuators (which may be piston and cylinder assemblies) operated hydraulically an in sequence; automatic sequencing of the actuators is normally achieved on a timed basis, or on a stroke/displacement limiting basis employing limit switches. However, either of these possesses disadvantages and may be extremely inefficient, particularly in terms of productivity, in some circumstances and in particular applications. This is particularly the case when sequencing is desirably not essentially related to time, or even necessarily to actuator stroke/displacement, but is more preferably related to the effort applied to the work as with the apparatus of the invention.

According to another aspect of the invention a control system, for controlling the sequencing of a plurality of hydraulic actuators such as the piston and cylinder arrangements of fastening apparatus in accordance with the invention, employs at least one pressure sensing device associated with the hydraulic feed to a corresponding one of the actuators, and a sequence control circuit which at least in part controls the sequencing of the actuators according to the feed pressure sensed by said device.

Preferably the pressure sensing device is a pressure transducer connected to a pressure level comparator which has a presettable comparison level and which provides an input signal to the control circuit when the sensed feed pressure reaches the comparison level. This transducer may be one of a plurality thereof individually associated with and sensing the feed pressures of said plurality of actuators, with each such transducer connected to its own presettable level comparator.

The control circuit preferably has a plurality of sequenced outputs respectively controlling operating solenoids of valves supplying the actuators. The latter are conveniently the piston and cylinder assemblies of fastening apparatus in accordance with the invention which are accordingly sequenced as and when the effort exerted by the pistons reaches the respective comparison level, as sensed by the pressure sensing means. The comparison pressures, at which the level comparators signal the control circuit to initiate the next sequencing step, can be readily and precisely preset to suit the thickness and grade of material being fastened and the punch pressure required to provide the desired clenching action. This is an example of apparatus where the sequential control is desirably related to actuator effort, i.e. the force at the punches, rather than to time or punch displacement, and hence the invention provides, for this apparatus, a new sequence control principle not previously employed.

The invention, according to a further aspect, comprises apparatus employing sequence control as described with sensing of actuator feed pressure, a hydraulic sequence control system operating as described, and sequence control means embodying said pressure sensing device or devices and said sequence control circuit operating, at least in part, in dependence on the feed pressure(s) sensed by the sensing device(s).

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
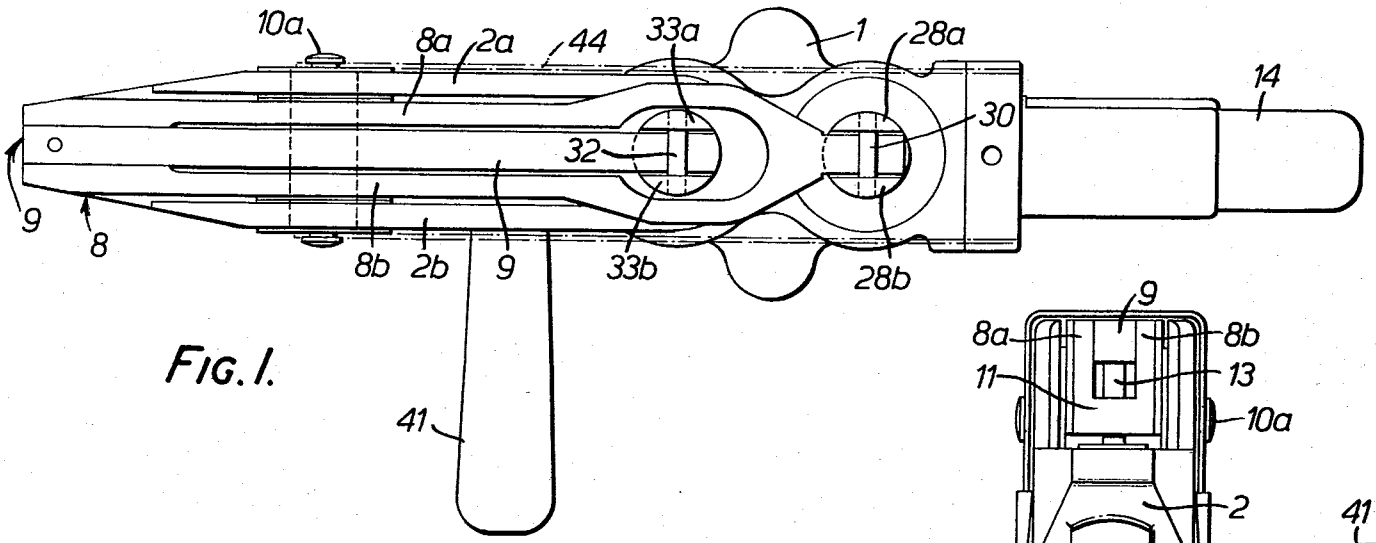
FIG. 1 is a top plan view of a first apparatus embodiment.
Figure 2:
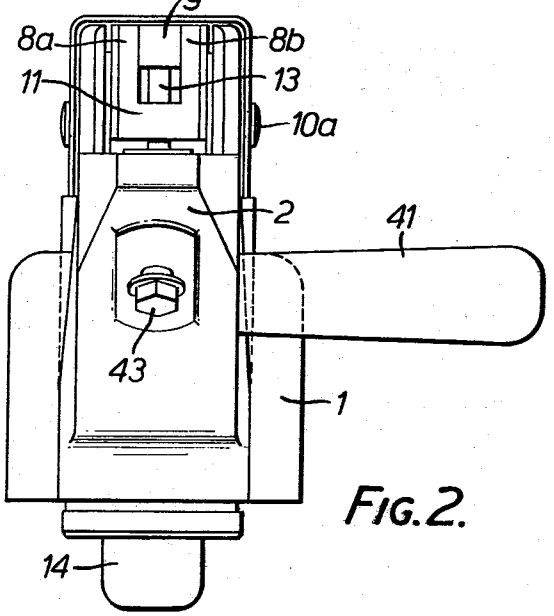
FIG. 2 is an end view from the left in FIG. 1.
Figure 3:
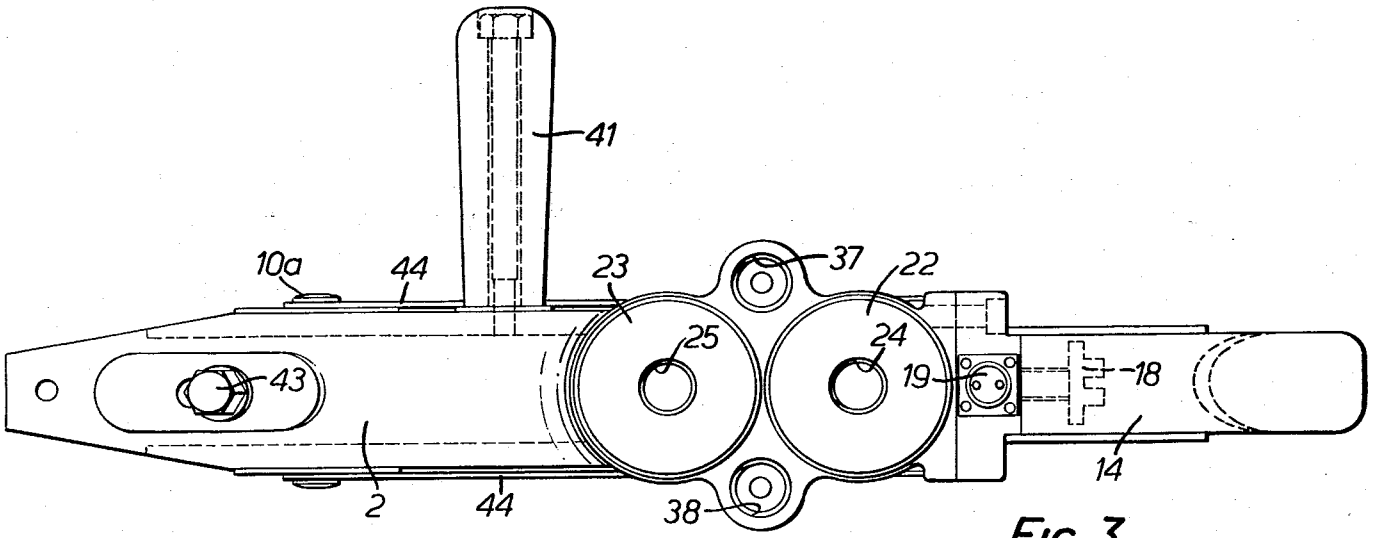
FIG. 3 is an underneath view thereof.

The hand-held clenching tool or "gun" shown in FIGS. 1 to 4 has a body 1 with a projecting integral arm 2 forming a fixed jaw which at its outer end has a seating 3 providing a mounting for a detachable piercing-and-forming punch 4 which is surrounded by a "urethane" stripper 5 housed in and projecting from a counterbore 6 at a work-supporting surface 7 of the arm 2.

The arm 2 is of U-shaped section with side limbs 2*a* and 2*b* between which are pivotally supported two further arms 8 and 9, these arms having hardened bearing bushes such as 10 which turn on a fixed pivot pin 10*a*. The arm 8 is longitudinally split over most of its length with side sections 8*a* and 8*b* between which the arm 9 is centrally positioned. The outer end of the arm 8 is bridged at 11 to form a movable jaw and provide a die mounting section with a counterbored mounting for a detachable piercing and forming die 12 which cooperates with the punch 4 in a manner to be described. The adjacent outer end 9*a* of the inner arm 9 which forms a second movable jaw has a counter-bored mounting for a detachable flattening punch 13 which also functions in a manner to be described.

The body 1 has a pistol-type handgrip 14 at the end remote from the projecting arm 2, and this houses a trigger-type control member 15 with a return spring 16 and which carries a vane 17 co-operable with an opto-electronic encoder "switch" 18 to provide an initiating control signal when the trigger member 15 is depressed. This electrical control signal is provided at a lower plug and socket connection 19 which also connects the supply voltage for the encoder 18.

The body 1 is bored and counterbored from its lower side to provide two hydraulic cylinders 20 and 21 closed at their bottom ends by screwed plugs 22 and 23 with threaded tappings 24 and 25 for the connection of the gun in the hydraulic control circuit by means of flexible hoses. The cylinders 20 and 21 respectively house hydraulic pistons 26 and 27. The piston 26 has an upwardly projecting rod 28 with a forked end which has a double-acting connection with an end portion 8*c* which bridges the side portions 8*a* and 8*b* of the pivotal arm 8. This double-acting connection is provided by a contoured captive articulated-joint member 29 below the arm 8 and a pin 30 which extends across the fork limbs 28*a* and 28*b* of the piston rod 28. The piston 27 is similarly connected to the adjacent end portion 9*b* of the central arm 9, by means of a contoured captive joint member 31 and a cross pin 32 extending between the fork limbs 33*a* and 33*b* of the upwardly projecting piston rod 33.

The pistons 26 and 27 and the piston rods 28 and 33 carry conventional lip-type seals 34 and the upper sealed cylinder chambers 35 and 36 respectively communicate with bottom threaded tappings 37 and 38 providing further hose connections at the bottom of the body 1. The piston 27 is hollow and houses an "initial hold" spring 39 which urges the piston 27 in the upward direction and thus urges the flattening punch 13 towards the piercing-and-forming punch 4 whereby to lightly grip the work (for example two metal webs shown in broken lines at 40) while the gun is accurately positioned before initiating a clenching cycle.

The punches 4 and 13, and the die 11, are a press fit in their respective mountings on the fixed and movable jaws. They are thus readily removable and replaceable, either when worn or to change them to suit different work or provide a different form of clenched fastening.

A side handle 41 is mounted on the side of the arm 2 so that it can be gripped in the left hand to steady the tool with the pistol grip 14 held in the right hand, and an adjustable depth stop 42 is mounted within the fixed arm 2. This stop is locked in the adjusted position by means of a set screw 43 and limits the depth of insertion of the work 40 between the jaws of the tool. A pressed steel dust cover 44, which protects the arm pivot bearings and connections, is fixed on the body 1 by a screw 45 at the back and retained at the front by slots 46 which engage peripheral grooves in the pivot pin 10*a* as the cover 44 is fitted. This engagement also serves for axial location of the pivot pin itself.

Figure 5:
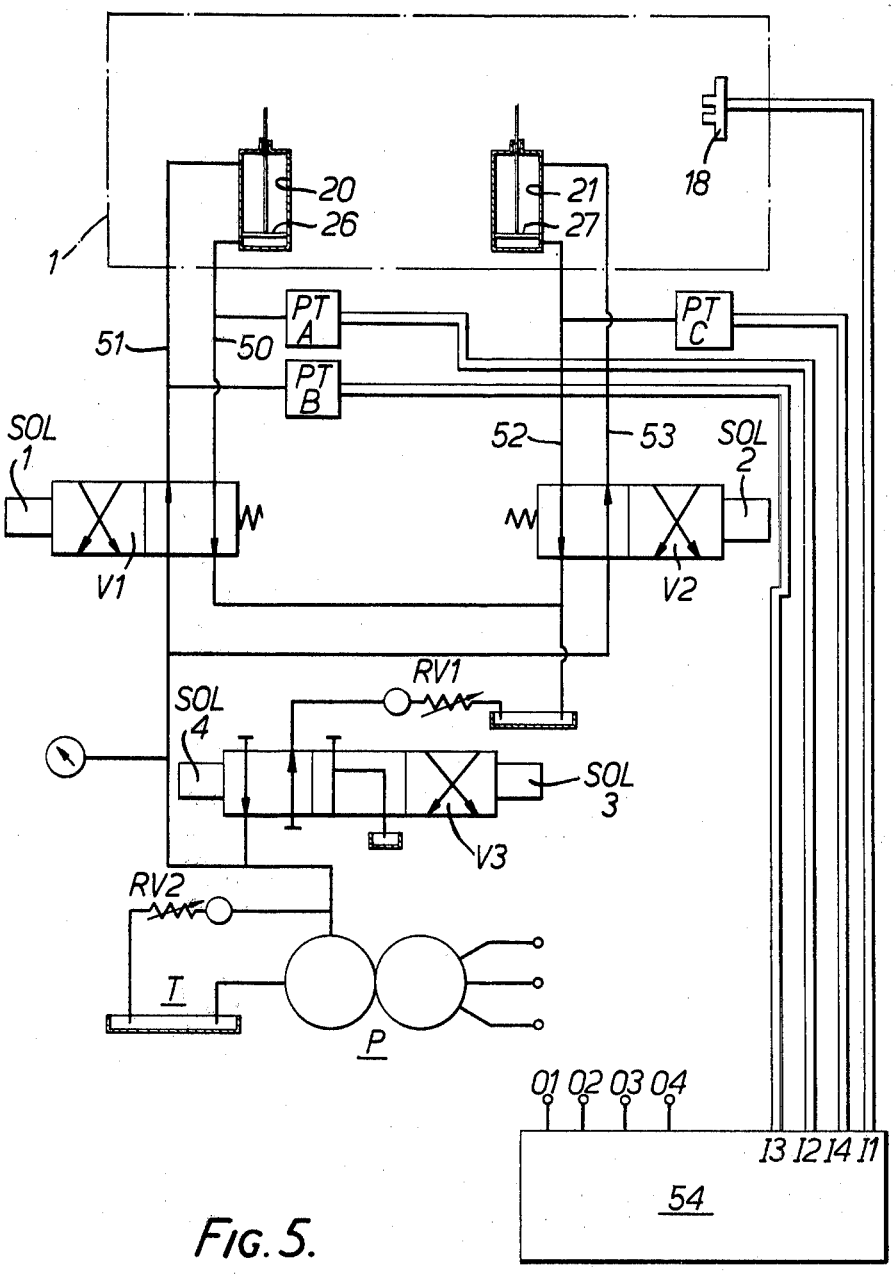
FIG. 5 illustrates diagrammatically the hydraulic control system of this embodiment.

The operation of the tool will now be described with particular reference to the hydraulic control system of FIGS. 5 and 6. In FIG. 5 the tool body 1 is indicated in broken outline and in block form, the bottom and top chambers of the cylinder 20 respectively being connected to the hydraulic circuit by flexible hoses 50 and 51. The bottom and top chambers of the cylinder 21 are similarly connected by means of flexible hoses 52 and 53. The control system includes a solid state control circuit 54, shown in block schematic form in FIG. 6, which receives an initiating electrical signal from the trigger switch 18 at one input I1.

A single-acting spring-returned solenoid valve V1 controls the cylinder 20 and has an operating solenoid SOL1. A similar solenoid valve V2 controls the cylinder 21 and has an operating solenoid SOL2. The hydraulic circuit is supplied from a hydraulic supply comprising a motorised pump P and a tank T back to which the system exhausts, through a double-acting solenoid valve V3 with operating solenoids SOL3 and SOL4. The energisation of the four solenoids is controlled, respectively, by outputs 01, 02, 03 and 04 of the control circuit 54.

Three pressure transducers PT.A, PT.B and PT.C respectively sense the feed pressures in the flexible hoses 50, 51 and 52. The transducers supply pressure-responsive signals to transducer inputs I2, I3 and I4 of the control circuit 54. When solenoid SOL3 is energised the valve V3 provides a low pressure supply of 400 p.s.i. (0.28 Kg/mm$^2$) to the system, this pressure being governed by an adjustable relief valve RV1. Alternatively, when solenoid SOL4 is energised the full supply pressure is applied to the circuit through an adjustable relief valve RV2.

Figure 6:
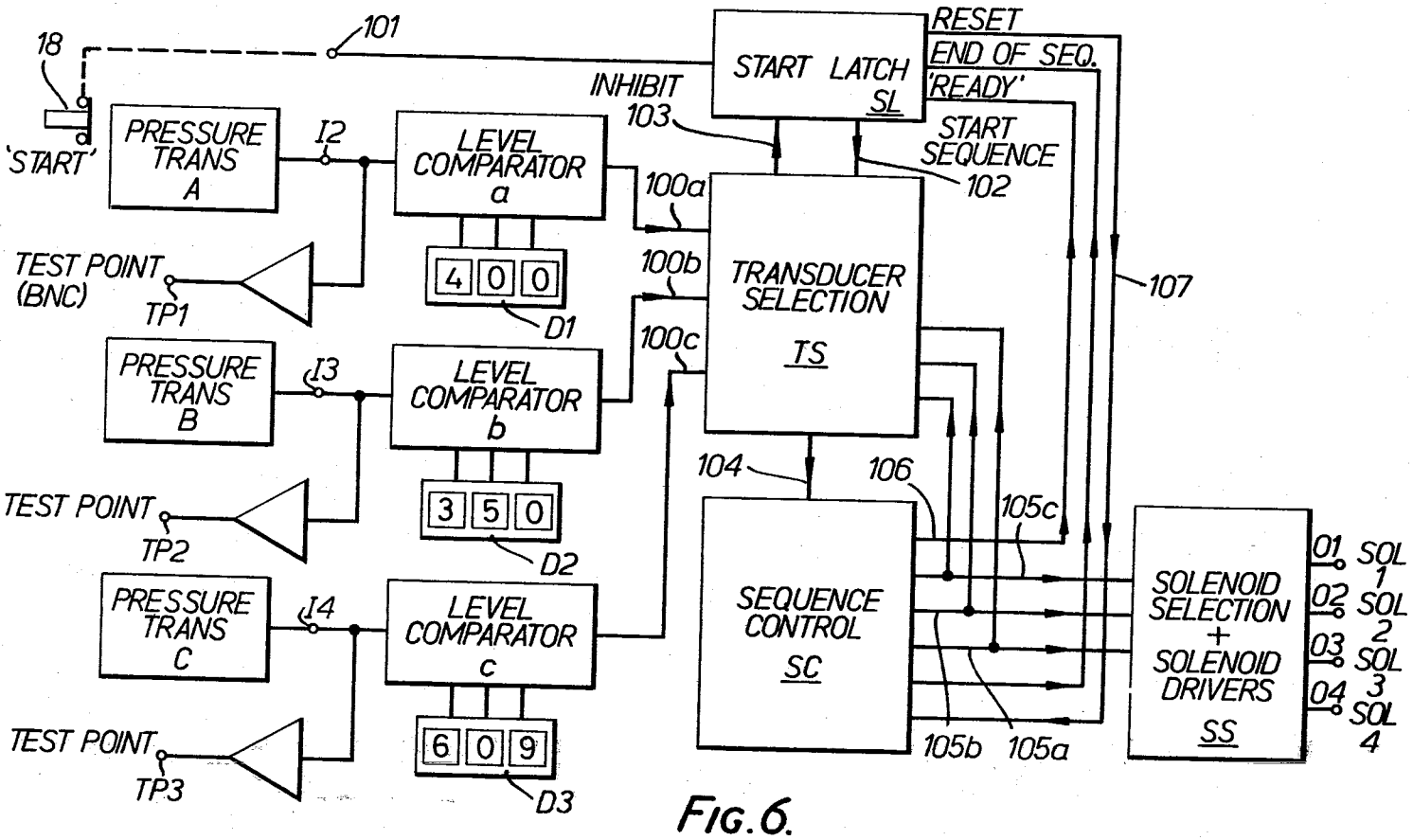
FIG. 6 is a block schematic diagram of the logic control circuit of the system.

Referring now to the schematic block diagram of FIG. 6, the control circuit 54 comprises three principal sections—a main Sequence Control section SC, a Transducer Selection section TS and a Solenoid Selection section SS which incorporates the solenoid drivers and provides the outputs 01 to 04—plus a Start Latch section SL and three level comparators LCa, LCb and LCc with said inputs I2, I3 and I4. Each of these comparators is presettable, by means of non-illustrated digital switches mounted on a control panel, to a desired comparison pressure. The preset comparison pressures are indicated by digital panel displays D1, D2 and D3.

The comparators LCa, LCb and LCc are respectively connected to the Transducer Selection section TS by lines 100*a*, 100*b* and 100*c*, and they provide signals thereto when the sensed feed pressures are equal to (or larger than) the preset comparison pressures. Buffered test points TP1, TP2 and TP3 enable test signals to be set in to the circuit to check the level comparators and the operation of the system as a whole.

The Start Latch section SL receives an initiating 'start' signal at input 101 from the trigger switch 18 as a result of which, unless it is in an 'inhibited' state, it provides a 'start' signal on line 102 to the section TS. The section TS as a result supplies a 'next stage' switching signal to the section SC on line 104, and the latter section has alternative sequenced outputs 105*a*, 105*b* and 105*c* which command the sections TS and SS. It also has one further output on line 106 by which it supplies a 'ready' signal to the start Latch SL, which for its part supplies 'reset' signals to the section SC on line 107. Thus the section SC can be looked on as the "heart" of the system, and it provides signals for input selection (by the section TS) and for output selection (by the section SS) by the rest of the logic.

On "switch on" the Sequence Control section SC automatically returns to a reset condition, giving a 'ready' signal to the Start Latch via line 106 and deactivating all the solenoid drivers except for that which controls solenoid SOL3. Thus in the "switch on" condition the other three solenoids are de-energised, V1 and V2 being positioned to hold the die 12 and punch 13 clear of the work, and solenoid SOL3 is energised to provide a low pressure supply from V3 to drive the system and retract both piston 26 and 27.

Figure 9:
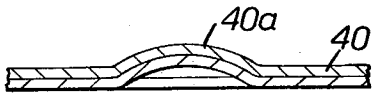
FIG. 9 is a section on the line B—B in FIG. 7.

The receipt of a 'start' control signal from the switch 18, when the trigger member 15 is depressed, results (if the Start Latch is not inhibited) in a 'start sequence' pulse to the Transducer Selection section TS on line 102 and the latter section then signals 'next stage' to the Sequence Control section SC on line 104. This causes the control circuit to step on to Stage 1 of the cycle, in which solenoids SOL1 and SOL4 are energised and solenoids SOL2 and SOL3 de-energised. This positions V1 so that the hydraulic pressure raises the "pierce" piston 26 to close the die 12 on to the punch 4. This pierces and forms a localised region of the work, producing the raised formation shown in FIG. 9 projecting above the plane of the work. During the piercing and forming phase the full hydraulic supply pressure is available, due to the de-energisation of solenoid SOL3 and the energisation of SOL4, and the work is held against the fixed jaw surface 7 with the stripper 5 compressed into the recess 6.

During Stage 1 of the cycle the Transducer Selection section TS is "looking" at level comparator LCa which, when the pierce piston operating pressure sensed by PT.A reaches the corresponding preset comparison level, signals the logic via line 100*a*. This causes the Transducer Selection section TS to supply another 'next stage' signal to the Sequence Control section SC, which accordingly steps on to Stage 2 of the cycle and commands sections TS and SS accordingly.

During Stage 2 the section TS selects PT.B and the section SS de-energises solenoid SOL1, while SOL4 remains energised and SOL2 and SOL3 remain de-energised, thereby changing over the valve V1 to lower the pierce piston 26 and thus raise the die 12 clear of the work. When the die is fully raised the pressure at PT.B rises to the corresponding preset comparison level at LCb, whereupon the latter signals the section TS which send another 'next stage' signal to the Sequence Control section SC which accordingly steps on to Stage 3.

Figure 8:
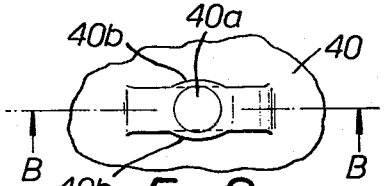
FIG. 8 shows to an enlarged scale a typical clenched joint produced with an apparatus in accordance with the invention.
Figure 7:
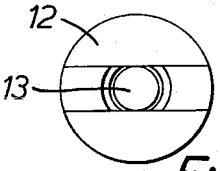
FIG. 7 is a detail view taken on the face of a piercing-and-forming die of this embodiment.
Figure 4:
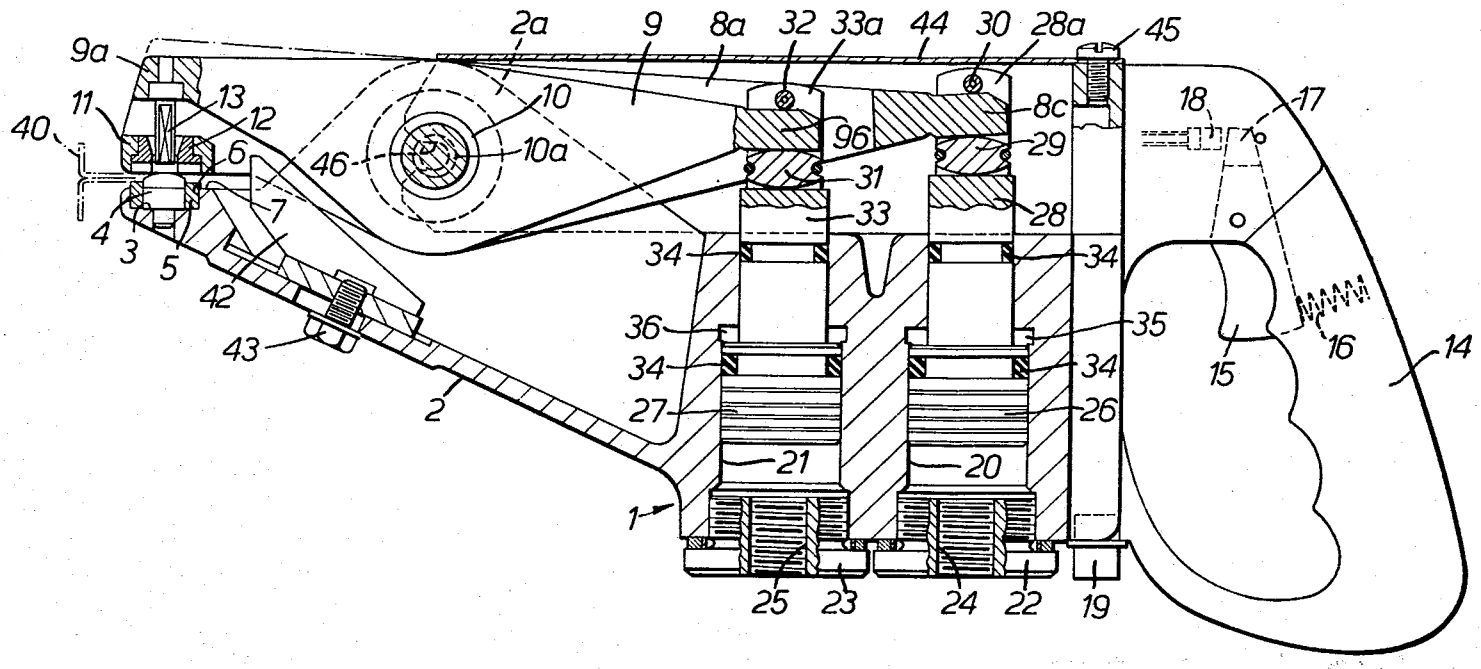
FIG. 4 is a section on line A—A in FIG. 1.

During Stage 3 transducer PT.C becomes operative and section SS energises solenoid SOL2 and SOL4 with SOL1 and SOL3 de-energised. The result is that valve V2 now changes over to raise the piston 27 and thus close the flattening punch 13 down on to the work over the punch 4 which still supports the deformed region 40*a* in the configuration shown in FIG. 9. The region 40*a* projecting above the work plane is thus compressed between the punches beyond the yield point of the work material, being flattened and spread out sideways above the work 40 and clenched tightly against the upper surface of the top web thereof as shown at 40*b* in FIG. 8. This clenching phase of the operation terminates when the pressure sensed by transducer PT.C rises to the preset level of comparator LCc when a signal to the logic section TS produces another 'next stage' signal to the Sequence Control section SC which accordingly steps on to Stage 4.

Stage 4 is in fact the end of the sequence, and a 'reset' signal on line 107 from the Start Latch is initiated which returns the whole system to the rest condition. At this point the section SS operates to de-energise solenoids SOL2 and SOL4, with SOL1 remaining de-energised, and to energise solenoid SOL3. The system is now ready for the next cycle, which commences on operation of the trigger member 15 after the tool has been moved to a new position or engaged with a fresh workpiece.

As has been mentioned, an operator start signal will only activate the Start Latch section SL to initiate a sequence cycle if the latch is not inhibited. Starting is inhibited to prevent inadvertent operation if the system is already involved in a fastening operation, i.e. if a 'ready' signal from the Sequence Control section is not available on line 106, or if any one of the pressure transducers PT.A, PT.B and PT.C is sensing a high pressure. In the latter case an 'inhibit' signal is supplied by the section TS on line 103, and in this context a "high pressure" is a pressure at least equal to the corresponding preset comparison pressure.

It will be readily apparent that the use with the described apparatus of pressure transducers to control the sequencing cycle, in accordance with the present invention, not only enables an operating cycle to be completed efficiently and without time wastage, particularly in a manually-operated tool, but also enables the jaw closing forces of the two movable jaws to be adjusted accurately and precisely, to suit the thicknesses and nature of the work material as well as the die and punch forms used. This simplified control and adjustment is in marked contrast to prior arrangements used with this type of apparatus, and not only is setting-up time reduced but consistently excellent clenched fastenings are readily achieved using unskilled or semiskilled labour.

Those skilled in the art will also readily appreciate that the logic circuitry of FIG. 6 can easily be assembled from standard components, as a simple design exercise and in particular without need for further description herein when the necessary functions of the control circuit have been described.

Figure 10:
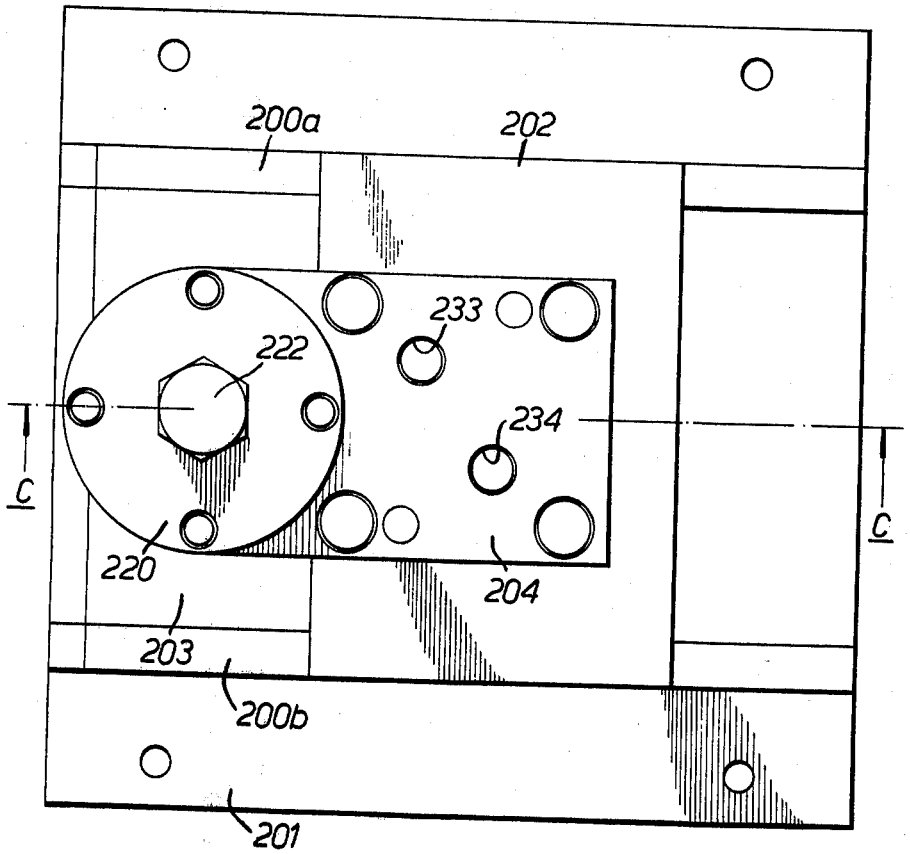
FIG. 10 is a top plan view of the second apparatus embodiment.
Figure 11:
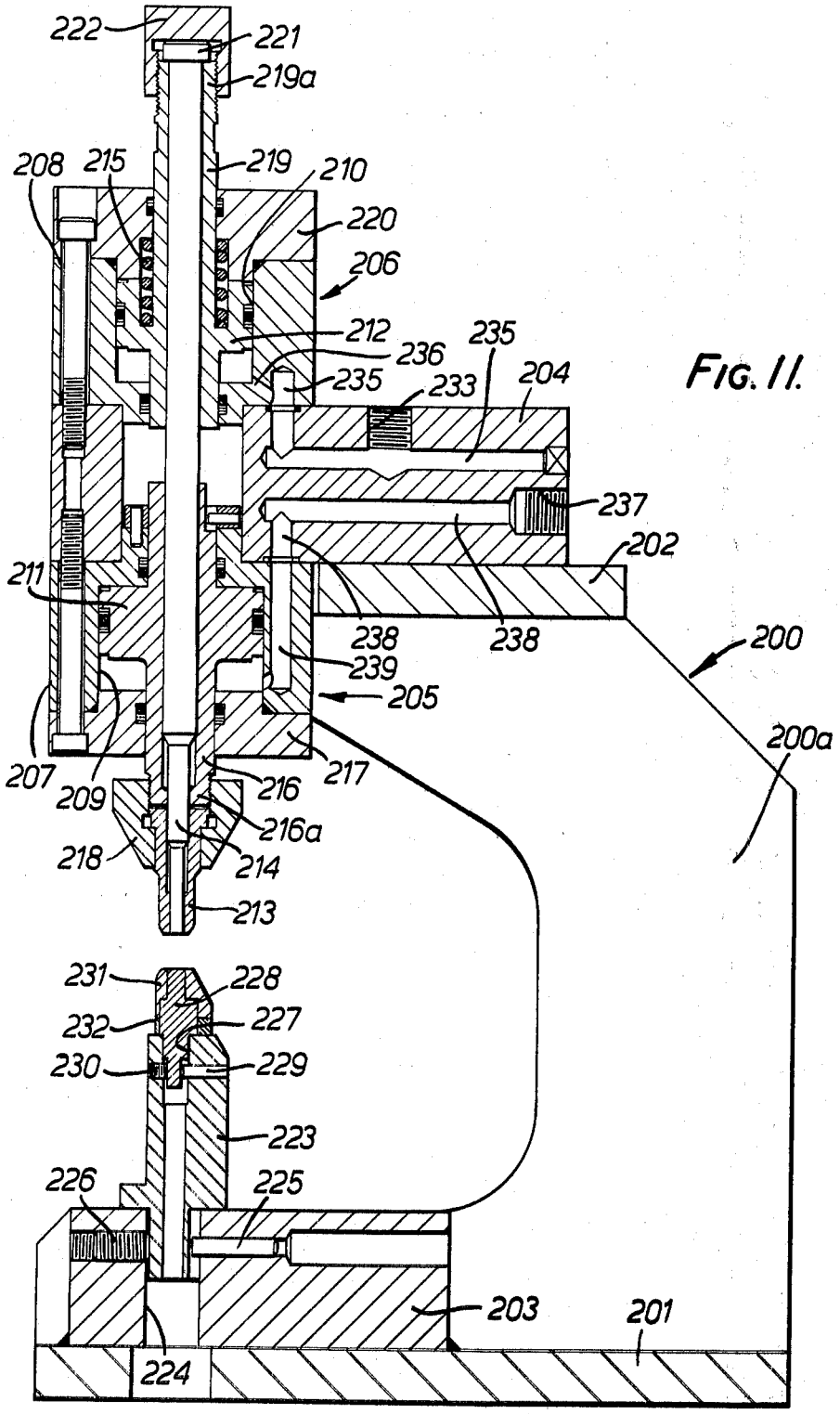
FIG. 11 is a section on the line C—C in FIG. 10.

In the apparatus embodiment of FIGS. 10 and 11, which is a readily portable but in use static form of the apparatus, for example being bench mounted, the hydraulic piston/cylinder arrangements are disposed coaxially one above the other on the upper limb of a 'C' frame 200. This frame is fabricated with two spaced side plates 200*a* and 200*b* welded to a base plate 201. A cross member 202 welded across the side plates provides the upper limb of the frame and a block 203 welded to the base plate 201 and extending between the side plates provides the bottom limb of the frame.

A connecting block 204 bolted on to the cross member 202 provides a mounting for a pierce piston/cylinder assembly 205 and a coaxial clench piston/cylinder assembly 206. These assemblies are bolted to the block 204, the assembly 205 being disposed below and the assembly 206 above the block 204. The assemblies 205 and 206 have cylinder bodies 207 and 208 respectively bored to provide cylinders 209 and 210 in which are housed coaxial pistons 211 and 212 which respectively and directly actuate a piercing-and-forming die 213 and a flattening punch 214. As in the previous embodiment the piston 212 is loaded, so that the punch 214 lightly grips the work, by a spring 215 within the assembly 206.

The piston 211 has an integral piston rod 216 which projects downwardly through a cylinder end cap 217 and which, at its lower end, provides a mounting section 216*a* for the die 213 which is retained in position by a nut 217. The piston 212 has an integral upwardly projecting piston rod 219, which projects through a cylinder end cap 220 and at its upper end 219*a* provides a mounting section for the punch 214. This punch passes through both pistons and piston rods, which to this end are bored through, and has an upper end flange 221 which seats on the end mounting on the rod 219 and by which it is retained in position by a cap nut 222. Thus in this case also the die 213 and punch 214 are readily removable and replaceable.

The lower block 203 of the frame 200 supports an anvil 223 which locates in a mounting bore 224, a dowel 225 providing angular location and a grubscrew 226 fixing the anvil in position. The anvil 223 has a locating bore 227 and a top seating providing a mounting for a piercing-and-forming punch 228, which is similarly angularly located and fixed by dowel 229 and grubscrew 230. This punch 228 co-operates with the die 213 and the upper punch 214 in the same manner as that already described in respect of the corresponding die and punches of the first embodiment, for the clench fastening of overlying metal sheets or webs. For example, for the securing of metal sheet panels to angle or channel framing.

The block 204 serves as a connecting block for hoses connecting the tool in the hydraulic circuit, which may be generally as already described with particular reference to FIGS. 5 and 6. However, it will be appreciated that fastening apparatus in accordance with the invention can be used with any other suitable form of hydraulic control circuit, automatic or manual, operative to provide the required sequential movement of the hydraulic pistons to pierce, form and clench the work. The block 204 has top threaded tappings 233 and 234 for the connection, respectively, of hoses to the lower and upper ends of the cylinder 210, FIG. 11 showing the drilling 235 in the block 236 in the body 201 by which the tapping 233 communicates with the lower end of the cylinder 210. The block 204 also has rear side tappings which respectively communicate with the two ends of the cylinder 209. Only one of these two tappings, identified as 247 and which communicates with the lower end of the cylinder 209, is shown in the drawings and it does so through drillings 238 in the block 204 and 239 in the cylinder body 207.

What is claimed is:

1. In an apparatus operable to fasten together overlying metal sheets or webs, wherein a co-operating piercing-and-forming punch and die set is operable partially to sever and to displace a localised region of said sheets out of the planes thereof, and a flattening punch is then operable to spread the displaced region and thus fasten the sheets together with a clenching action, the improvement comprising:

a die mounting section on which said piercing-and-forming die is mounted;

a punch mounting section on which said flattening punch is mounted;

first and second hydraulically-operated piston and cylinder arrangements by which said die and punch mounting sections are respectively and separately operable, in sequence, for required movements relatively to said piercing-and-forming punch;

first and second lever arms which share a common intermediate pivot axis and at adjacent ends of which said piercing-and-forming die and said flattening punch are respectively mounted, said piston and cylinder arrangements including hydraulic pistons acting at the other ends of said first and second arms; and a third lever arm with which each of said first and second lever arms has a scissor relationship, which is fixed with respect to hydraulic cylinders of said piston and cylinder arrangements, and which mounts said piercing-and-forming punch.

2. In an apparatus operable to fasten together overlying metal sheets or webs, wherein a co-operating piercing-and-forming punch and die set is operable partially to sever and to displace a localised region of said sheets out of the planes thereof, and a flattening punch is then operable to spread the displaced region, and thus fasten the sheets together with a clenching action, the improvement comprising:

a die mounting section on which said piercing-and-forming die is mounted;

a punch mounting section on which said flattening punch is mounted; and first and second hydraulically-operated piston and cylinder arrangements by which said die and punch mounting sections are respectively and separately operable, in sequence, for required movements relatively to said piercing-and-forming punch;

said movable punch and die operating sections being directly actuated by said first and second piston and cylinder arrangements, with said piston and cylinder arrangements coaxially disposed in line with linear operative movement of the piercing-and-forming die and the flattening punch.

3. Apparatus according to claim 1, in the form of a hand-held clenching tool and comprising a body which is rigid with said third arm, said body being provided with a pistol-type hand grip.

4. Apparatus according to claim 1, wherein said piston and cylinder arrangements are disposed side by side in the longitudinal direction of said third arm.

5. Apparatus according to claim 1, wherein said second piston and cylinder arrangement which operates said flattening punch is disposed nearer to said common pivot axis than is said first piston and cylinder arrangement.

6. Apparatus according to claim 3, wherein a trigger-type control member is built into said hand grip, and further comprising a hydraulic control circuit, and wherein actuation of said control member provides an electrical control signal for said hydraulic control circuit, which operates to sequence said piston and cylinder arrangements in the appropriate manner, and flexible hoses connecting said control circuit to the hydraulic cylinders of the piston and cylinder arrangements, both of which are double acting.

7. Apparatus according to claim 2, wherein a piston rod of said first piston and cylinder arrangement which operates the piercing-and-forming die projects towards said piercing-and-forming punch to provide said die mounting, and said piston rod is hollow to allow passage of the flattening punch which is connected to the piston of said second piston and cylinder arrangement.

8. Apparatus according to claim 2, wherein a piston rod of said second piston and cylinder arrangement is also hollow and projects in the opposite direction, i.e. away from the piercing-and-forming punch, to provide said mounting for the flattening punch which thus passes coaxially through both said pistons.

9. Apparatus according to claim 1 further comprising a control system for controlling the sequencing of said hydraulically operated piston and cylinder arrangements including at least one hydraulic feed connected to said piston and cylinder arrangements, at least one pressure sensing device connected to said hydraulic feed, and a sequence control circuit which at least in part controls the sequencing of said piston cylinder arrangements according to the feed pressure sensed by said sensing device.

10. A control circuit according to claim 9, further comprising a pressure level comparator, and wherein said pressure sensing device is a pressure transducer connected to said pressure level comparator which has a presettable comparison level, said comparator operating to provide an input signal to the control circuit when the sensed feed pressure has reached a preset comparison level.

11. Apparatus according to claim 2 further comprising a control system for controlling the sequencing of said hydraulically operated piston and cylinder arrangements, including at least one hydraulic feed connected to said piston and cylinder arrangements, at least one pressure sensing device connected to said hydraulic feed, and a sequence control circuit which at least in part controls the sequencing of said piston cylinder arrangements according to the feed pressure sensed by said sensing device.

* * * * *